US009803387B2

(12) United States Patent
Groesel

(10) Patent No.: US 9,803,387 B2
(45) Date of Patent: Oct. 31, 2017

(54) PNEUMATIC TENT, ESPECIALLY STAR-SHAPED CANOPY TENT

(71) Applicant: ADVENTURE DESIGN GmbH, Hartha (DE)

(72) Inventor: Ralf Henning Groesel, Leipzig (DE)

(73) Assignee: Adventure Design GMBH, Hartha (DE)

( * ) Notice: Subject to any disclaimer, the term of this patent is extended or adjusted under 35 U.S.C. 154(b) by 0 days.

(21) Appl. No.: 14/584,682

(22) Filed: Dec. 29, 2014

(65) Prior Publication Data

US 2015/0267436 A1 Sep. 24, 2015

(51) Int. Cl.

| | |
|---|---|
| ***E04H 15/20*** | (2006.01) |
| ***E04H 15/26*** | (2006.01) |
| ***E04H 12/22*** | (2006.01) |
| ***E04H 15/10*** | (2006.01) |
| ***E04H 15/24*** | (2006.01) |
| *E04H 15/18* | (2006.01) |
| *E04H 15/60* | (2006.01) |

(52) U.S. Cl.

CPC ..... *E04H 15/20* (2013.01); *E04H 12/2246* (2013.01); *E04H 15/10* (2013.01); *E04H 15/24* (2013.01); *E04H 15/26* (2013.01); *E04H 15/18* (2013.01); *E04H 15/60* (2013.01); *E04H 2015/201* (2013.01); *E04H 2015/209* (2013.01)

(58) Field of Classification Search

CPC ..... E04H 15/10; E04H 15/20; E04H 15/22; E04H 15/26; E04H 15/32; E04H 15/62; E04H 2015/207; E04H 2015/201; F21V 21/22; F21V 21/32

USPC ..... 135/91, 96, 97, 99, 114, 117–119, 120.1, 135/120.4, 905; 52/2.11, 2.18, 2.21, 52/2.25; 362/362, 431; 40/540, 610, 214

See application file for complete search history.

(56) References Cited

U.S. PATENT DOCUMENTS

| | | | | |
|---|---|---|---|---|
| 3,234,685 A | | 2/1966 | Harrowe | |
| 3,415,475 A | * | 12/1968 | Goodman | F16M 11/00 248/158 |
| 4,068,418 A | * | 1/1978 | Masse | E04H 15/20 52/2.21 |
| 4,179,832 A | * | 12/1979 | Lemelson | F21S 2/00 345/32 |
| 4,537,210 A | * | 8/1985 | Montgomery | E04H 15/003 135/115 |
| 4,655,008 A | | 4/1987 | Parish | |
| 5,036,874 A | * | 8/1991 | Lynch | E04H 15/26 135/905 |

(Continued)

FOREIGN PATENT DOCUMENTS

| | | | | |
|---|---|---|---|---|
| DE | 112005002685 T5 | | 11/2007 | |
| JP | 2002194925 A | * | 7/2002 | E04H 15/20 |

*Primary Examiner* — Winnie Yip

(74) *Attorney, Agent, or Firm* — Cohen & Hildebrand, PLLC

(57) ABSTRACT

A pneumatic tent (1) with at least one pole (2) extending in final assembly position vertically from the mounting surface (8) and a dome-shaped tent cover (3) extending over the self-supporting pole (2) which is locked and tensioned with locking means (4) in relation to the mounting surface (8), wherein the pole (2) containing a pressurized filling gas is constructed as single or multiple layered and includes a controllable or adjustable illumination device (5) that is placed inside the pole (2).

18 Claims, 7 Drawing Sheets

(56) References Cited

U.S. PATENT DOCUMENTS

Figure 1:
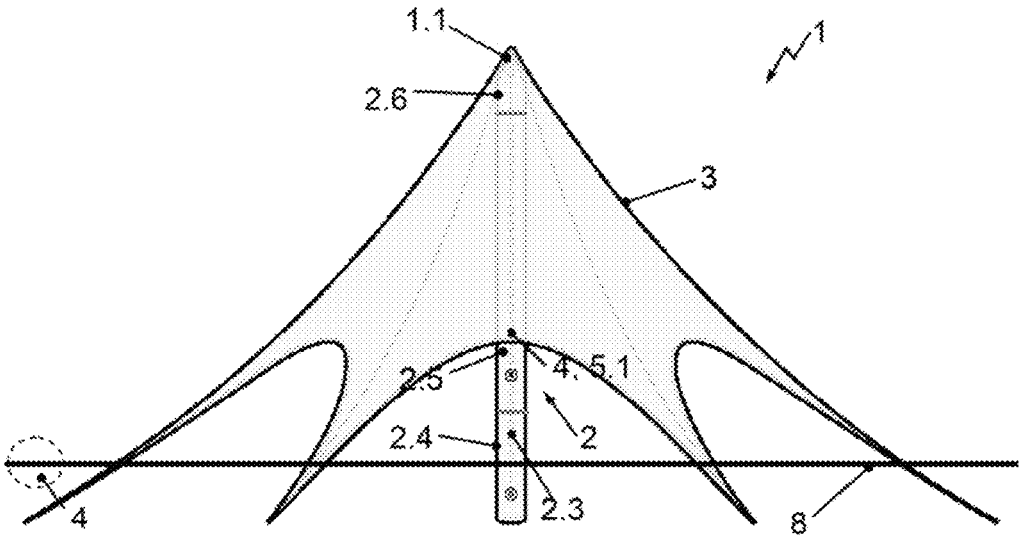

| | | | | | |
|---|---|---|---|---|---|
| 5,234,011 | A * | 8/1993 | Lynch | E04H 15/322 | 135/114 |
| 5,421,128 | A | 6/1995 | Sharpless | | |
| 5,477,876 | A * | 12/1995 | Moss | E04H 15/56 | 135/100 |
| 5,482,374 | A * | 1/1996 | Buhyoff | B65D 30/10 | 383/4 |
| 5,555,679 | A * | 9/1996 | Scherba | E04H 15/20 | 135/126 |
| 5,918,614 | A * | 7/1999 | Lynch | E04H 15/30 | 135/95 |
| 6,192,633 | B1 * | 2/2001 | Hilbert | E04H 1/1277 | 52/2.18 |
| 6,322,230 | B1 | 11/2001 | Medici | | |
| 7,552,555 | B2 * | 6/2009 | Pellecuer | E04H 15/20 | 40/610 |
| 8,789,549 | B1 * | 7/2014 | Barnes | E04H 15/62 | 135/118 |
| 9,125,467 | B2 * | 9/2015 | Randel et al. | E04H 15/32 | 206/378 |
| 2004/0050411 | A1 * | 3/2004 | Lawrence | E04H 15/20 | 135/128 |
| 2008/0291681 | A1 * | 11/2008 | Appleton | F21V 3/023 | 362/307 |
| 2010/0200038 | A1 * | 8/2010 | Roman et al. | E04H 15/48 | 135/44 |
| 2013/0271966 | A1 * | 10/2013 | Doble | A45B 3/04 | 362/183 |

* cited by examiner

PNEUMATIC TENT, ESPECIALLY STAR-SHAPED CANOPY TENT

BACKGROUND OF THE INVENTION (1) Field of the Invention

The expression pneumatic tents usually refers to inflatable tents and floating dome tents which are used where a simpler and faster installation, a low transport weight, a small packing size and possibly an increased advertising effectiveness are of significant importance.

(2) Description of Related Art

These pneumatic tents are often used only briefly, for example, as storage tent on large construction sites, as advertising pavilion, as a service tent for military operations, as a medical tent, as an emergency shelter, as a dwelling for traveling exhibitions, as festival hostel or as a pavilion for sports events, For the construction of pneumatic tents, three basic designs have dominated the market, wherein for maintaining the required internal pressure, the pneumatic tents are either filled with air only once and then closed off by valves, or a fan/compressor is operated permanently.

It is immanently important for the first design that the tent skin forming the shell of the tent is double-walled and subdivided into chambers, wherein each chamber is inflated individually or several chambers are inflated together.

The structure of a geodesic dome, which is supported by a positive pressure generated by the blower and has a correspondingly designed pressure lock for access, is distinguished from this double-walled design.

Lastly, the frame construction with an inflatable frame shall be mentioned, wherein the frame is at least partially covered by an additional tarpaulin forming an outer skin. Such tent structures are cherished primarily in camping applications, in the advertising industry and sporting events because of their almost limitless functional design and visual appearance and moreover, because no—often cumbersome—framework is required for their construction.

The latter types of pneumatic tents have manufacturing limitations when offerings of so-called star-shaped canopy tents as purely pneumatic tents are commercially desirable. Star-shaped canopy tents differ from other tents in that they have a greater height and thus provide a more comfortable "sensation of space" for the user.

Star-shaped canopy tents are composed, in essence, of a single vertically extending, centrally placed post usually made of aluminum or wood, and a dome-shaped tent skin extending across the apex of the post and distally guyed at several points by tensioning elements and thereby anchored in the ground. The assembly of such a post, which is inherently heavy due to its normal length of 4 m to 12 m, requires at least two people for assembly/disassembly, which inevitably represents an organizational and financial burden.

It has not been possible to date with the solutions currently available on the market to replace the heavy, centrally-placed aluminum or wooden post with a more manageable structure.

BRIEF SUMMARY OF THE INVENTION

It is therefore the object of the invention to propose a pneumatic tent, in particular a star-shaped canopy tent, which can be particularly easily handled by a single person during transport and during assembly/disassembly. In addition, the pneumatic tent should have greater functionality.

According to the invention, the pneumatic tent, especially a star-shaped canopy tent, has at least one pole extending in the final installation position vertically from the mounting surface and a tent cover extending over the self-supporting pole like a dome, which is locked and tensioned relative to the mounting surface with locking means, wherein the pole having a pressurized filling gas is formed with one or more layers and has a controllable or adjustable illumination device, which is placed inside the pole.

In a multi-layered pole, the individual layers are connected with one another permanently, for example in form of a laminate, and/or are superpositioned and/or placed next to each other without being bonded, similar to a so-called "onion skin structure".

The multilayered pole with layers that are superpositioned and/or placed next to each preferably includes a first layer, which is formed as an outer skin providing the exterior shape of the pole and acting as a support structure. A second layer is formed as an inner tube forming a filling gas reservoir that can be filled once, with at least one valve penetrating the outer skin, wherein the controllable or adjustable illumination device is placed either inside the inner tube designed as fillable filling gas reservoir or between the inner tube and the outer skin.

The employed filling gases are preferably pure oxygen, nitrogen, or a mixture thereof, or air. Although air, unlike nitrogen, is naturally available in unlimited quantities for free, pure nitrogen has the advantage over air, of which nitrogen represents a fraction, in that it has larger molecules that have a lesser tendency to diffuse.

In a preferred embodiment of the invention, however, only a single pole is employed which is centrally placed relative to the tent cover, with the dome-shaped tent cover spanning the apex of the pole. The outer shape is similar to the shape of a tent of the North American Indians, i.e. a teepee. Furthermore, it is also possible to provide two poles, which are used when the user desires a larger "covered" tent area.

With this solution, a pneumatic star-shaped canopy tent is available on the market for the first time, where not only the tent cover, but also the at least one illuminated pole, can be used as a backlit advertising space in addition to its function as a structural element, without the necessity to permanently operate a blower for maintaining the internal pressure.

Preferably, polyester, for example Dacron, is used as material for the robust outer skin of the pole.

The outer skin of the pole includes an abrasion-resistant base section that is resistant to mechanical forces, a center section and a head section operatively connected with the tent cover, wherein one or more sections have locking means in the form of loops, rings, Velcro or eyelets for securing the pole with respect to the mounting area and also for attaching functional elements in the form of illumination means, loudspeakers, advertising banners, brackets or control elements on the pole.

It has proven to be particularly advantageous when the operative connection between the conical head portion of the pole and the tent cover is realized by means of a Velcro fastener.

To give the pole in final assembled position adequate stability, it is provided that the cylinder-shaped pole is associated with a torus placed on the mounting surface, with the free cross-section of the torus being designed to conform to the cross-section of the pole, wherein the torus has weighting means and surrounds the foot section of pole in form of a closed loop and is optionally coupled with the pole. Water or sand is provided as weighting means for the torus, which are usually available free of charge at almost any installation site.

The supporting structure of the pole is formed according to the invention by the outer skin made of polyester in combination with the inner tube placed which is inside the outer skin and completely is surrounded by the outer skin. To ensure optimal conformity of the inflated inner tube to the outer skin, the material is preferably polyurethane (PU) in the form of a foil Such a construction, namely the assembly of a support structure with a high-strength Dacron outer skin and an inner PU foil, has proven in numerous trials to be particularly advantageous, since it can be used even under adverse weather conditions.

It has proven to be advantageous for selected applications of the subject matter of the invention to form the tent cover and/or the outer skin of the pole in multi-part or segment-like form, wherein the individual parts or segments are sewn together, glued, welded or joined together by a Velcro connection.

In practical applications, it has proven to be advantageous to provide in the foot section and/or in the center section of the pole at least one reservoir in which equipment to be stored, for example the compressor provided for a single filling, the power distribution, cable, and controller or regulator or locking means provided as replacement is placed. According to the concept of the invention, the optionally closable reservoir may be formed at a height of the pole in the area of the center section, which represents a user-friendly working height, i.e. between one meter and two meters.

Preferably, the illumination device has a plurality of LED and is designed as backlight for the pole, and further includes an adjusting and positioning device for aligning the LEDs inside the pole that are coupled with one another by cables or other conductive elements, such as carbon fiber, exactly with respect to their height and spacing relative to the outer skin of the pole. The adjusting and positioning device is constructed such that it can be operated even in the final assembly position of pneumatic tent. In the simplest case, spacers, guide pulleys, spaced-apart locking means and one or more tensioning ropes are provided, which are operatively connected with one another.

As already mentioned, the pole has an outer skin providing the outer shape and functioning as a supporting structure and an inner tube filling formed as a gas reservoir that can be filled once and has at least one valve penetrating the outer skin. It may also be advantageous for safeguarding against failure and ensuring functional and operational safety to provide several parallel inner tubes to produce a desired redundancy. The parallel design of the safety-related system ensures that in case of failure of an inner tube due to an unexpected drop in air pressure, the other inner tube(s) ensure(s) the required stability of the pole supporting the tent cover. This minimized the risk that all inner tubes placed in the pole malfunction at the same time.

The at least one inner tube includes a valve constructed as an inlet valve with integrated back-siphoning function and penetrating the outer skin. This means that an inner tube inflated using an electric pump, a pressurized air tank or a compressor can be readily emptied or evacuated again by switching the flow direction.

The invention has the following significant advantages and features compared to the prior art:

- a compact pneumatic tent with excellent functionality, which can be particularly easily handled by a single person during transport and assembly/disassembly,
- the pneumatic tent consists of at least one self-supporting pole and a dome-shaped tent cover extending over the pole, wherein the pole has a pressurized filling gas and is formed a single layer or as multiple layers and has a controllable or adjustable illumination device which is placed inside the pole,
- in a pole formed of multiple layers, the individual layers are permanently joined together, for example in the form of a laminate, and/or are layers that are superpositioned or arranged side-by-side without being bonded,
- in a pole formed of multiple layers, wherein the layers are superpositioned or arranged side-by-side without being bonded, a first layer is formed as an outer skin giving the pole its outer shape and functioning as a supporting structure, a second layer formed as an inner tube forming a filling gas reservoir that can be filled once and has at least one valve penetrating the outer skin, wherein the controllable or adjustable illumination device is placed either inside the inner tube formed as a finable filling gas reservoir or between the inner tube and the outer skin,
- not only the tent cover, but also the illuminated pole can be used, in addition to its function as a structural element, as backlit advertising space,
- the pole is formed as an once-fillable filling system without the necessity of having to continuously operate a blower to maintain the internal pressure,
- the tent cover and pole are only temporarily affixed to each other and are in engagement exclusively by way of a Velcro fastener engaged with each other, thus allowing easy interchangeability for various reasons,
- one or more sections of the pole include locking means in the form of loops, rings, Velcro fasteners or eyelets so that, on the one hand, the pole can be secured with respect to the mounting area and, on the other hand, functional elements in the form of illumination means, loudspeakers, advertising banners, supports or control elements can be attached to the pole,
- the cylinder-shaped pole is associated with a torus placed on the mounting area, wherein the free cross-section of the torus is formed so as to be compatible with the cross-section of the pole, wherein the torus has weighting means and circularly surrounds the foot portion of the pole and is optionally coupled with the pole and thus gives the pole adequate stability, and
- the illumination device is constructed as a backlight, which is placed inside the inner tube designed as a fillable filling gas reservoir or between the inner tube and the outer skin.

BRIEF DESCRIPTION OF THE SEVERAL VIEWS OF THE DRAWING(S)

Figure 2:
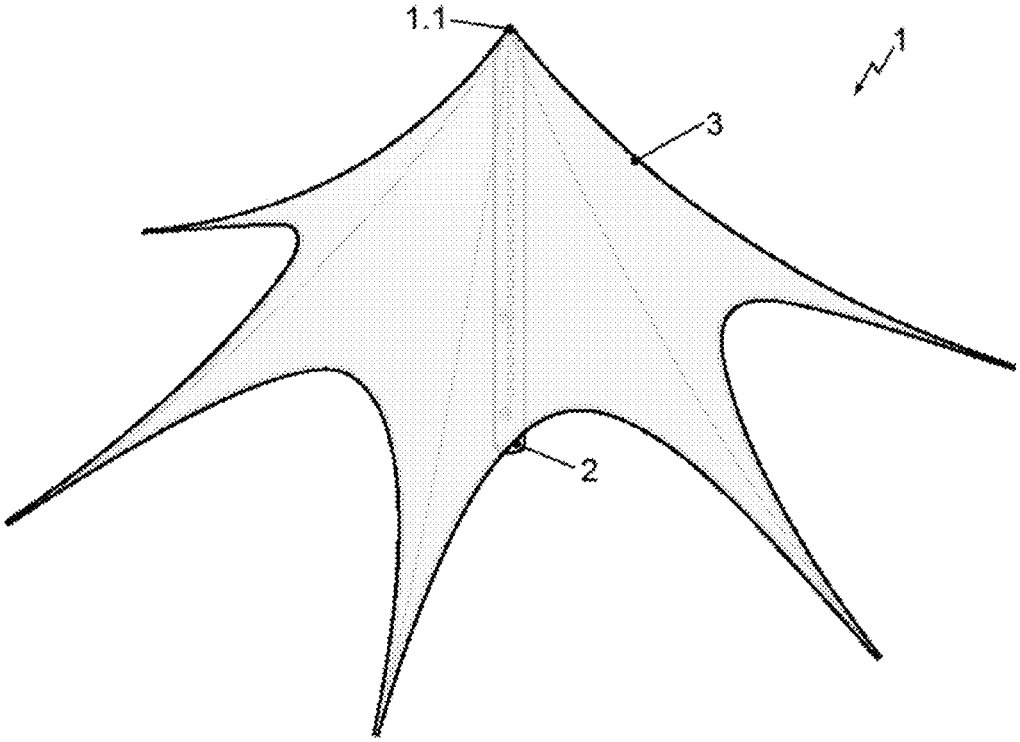
Figure 3:
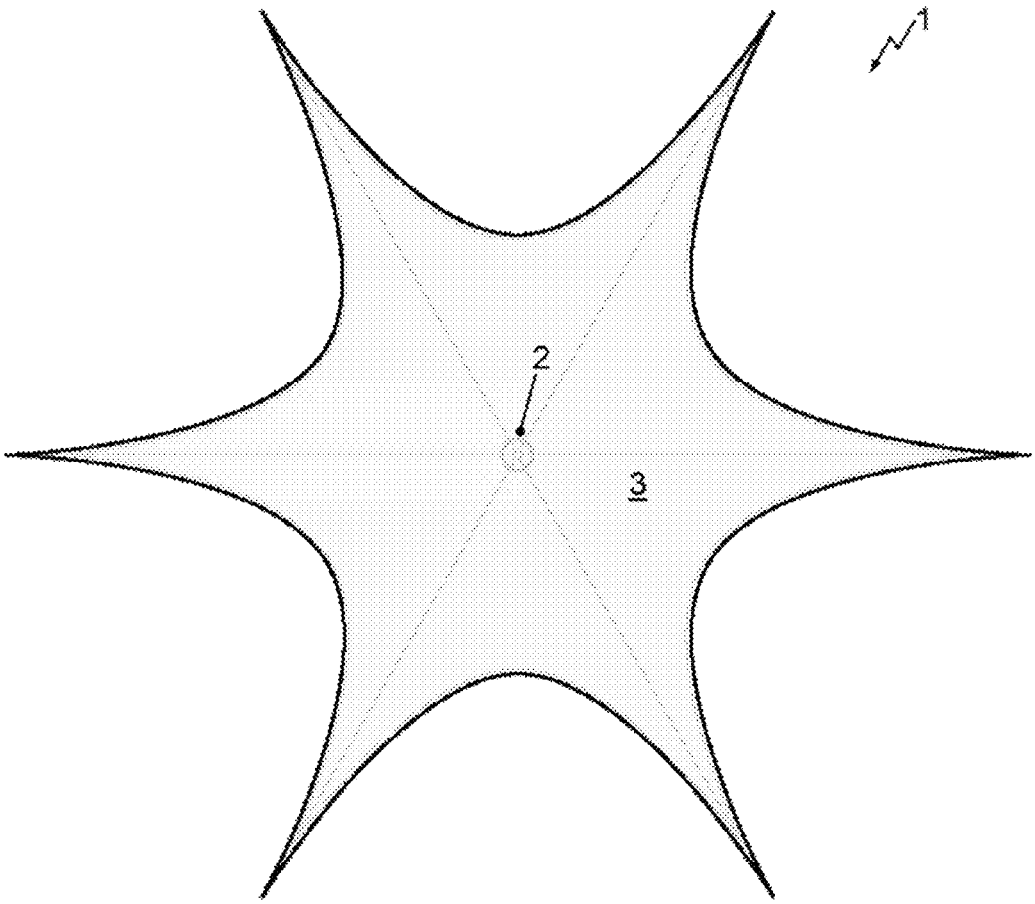
Figure 4:
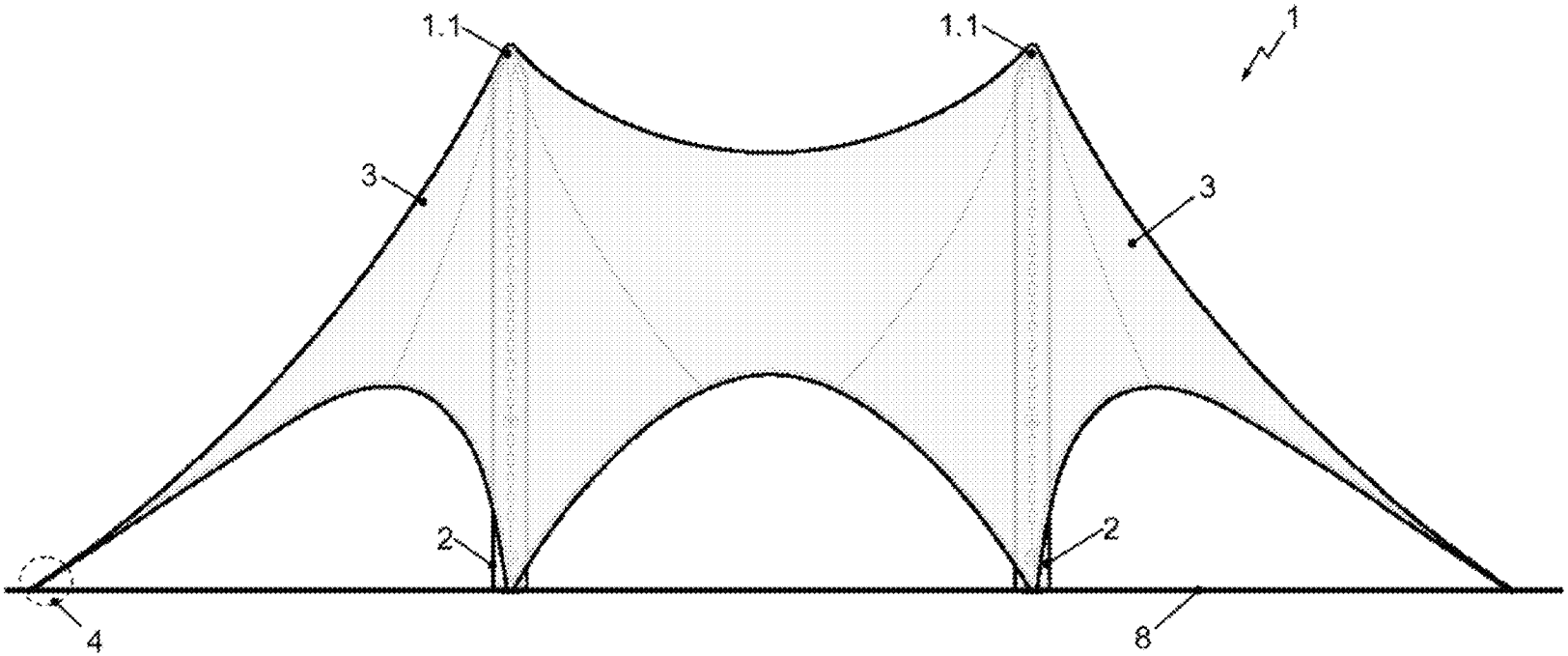
Figure 5:
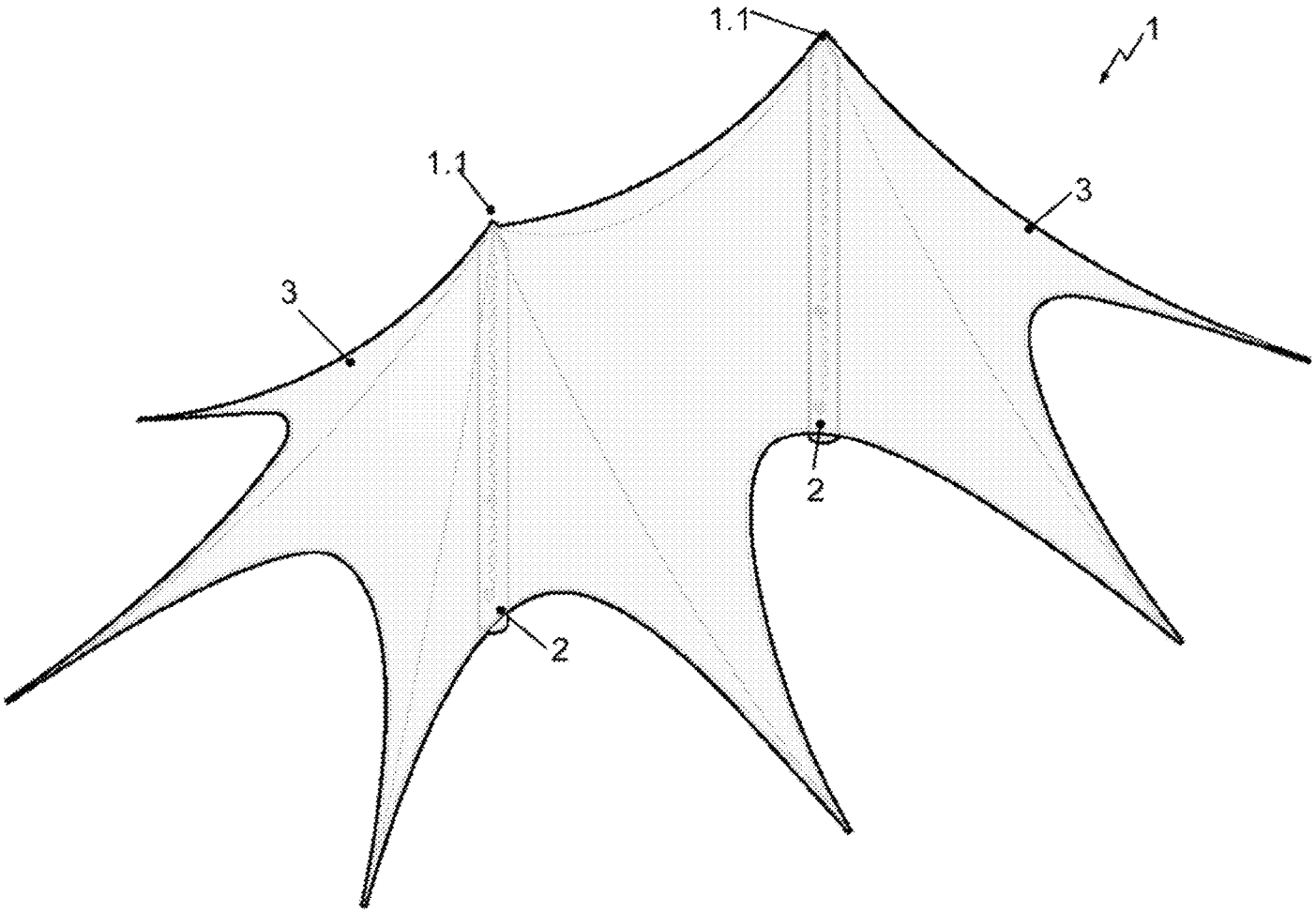
Figure 6:
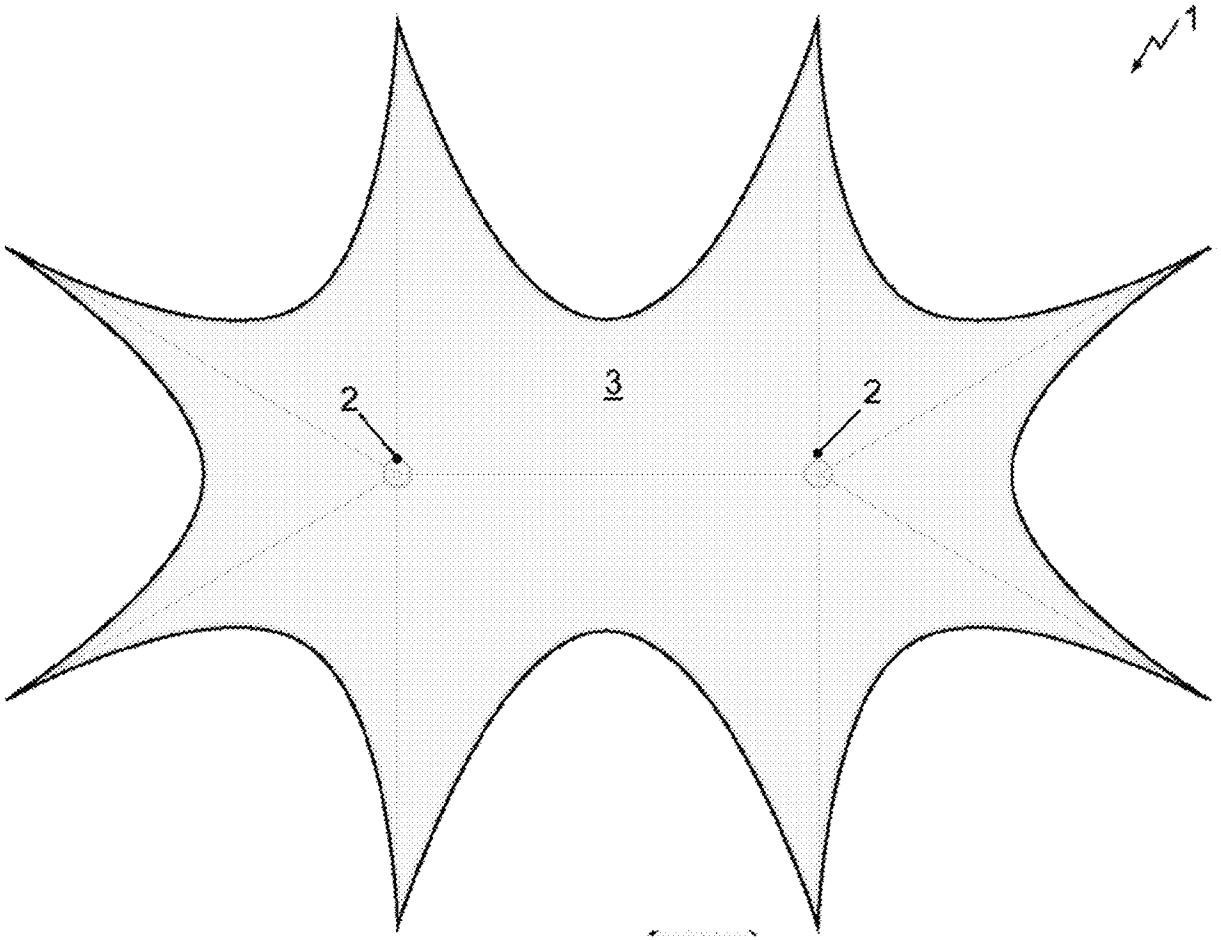
Figure 7:
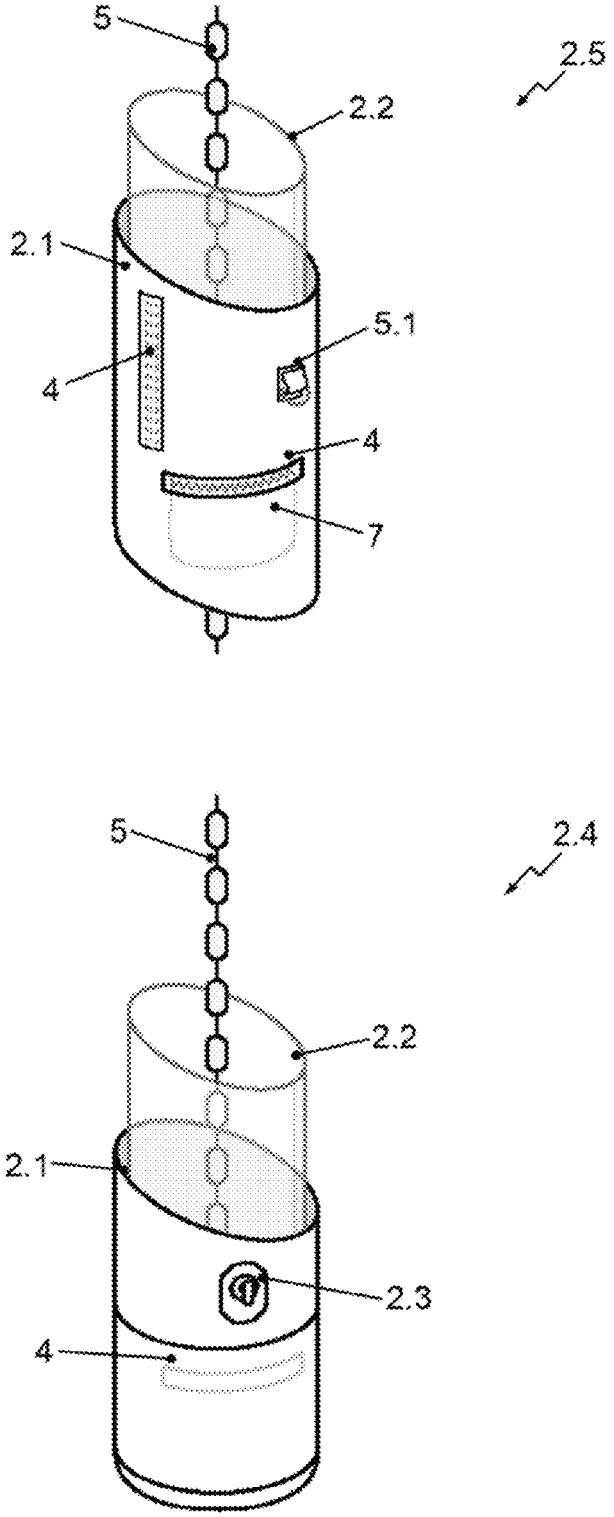
Figure 8:
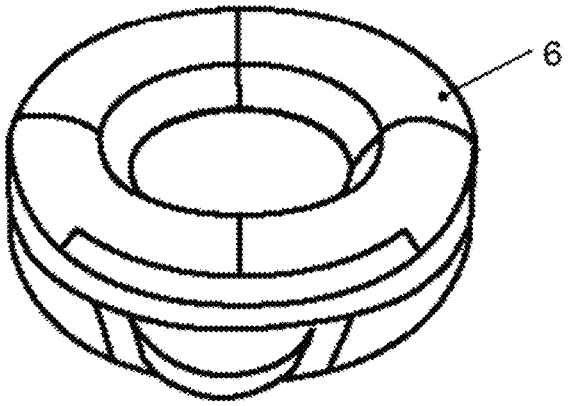

The aforementioned features and advantages of this invention can be better understood and assessed after a careful study of the following detailed description of preferred non-limiting exemplary embodiments of the invention in conjunction with the accompanying drawings, which shows in:

FIG. 1: a front view of the pneumatic tent in a first embodiment with a pole formed as a single layer, FIG. 2: a perspective view of the pneumatic tent in a first embodiment with a pole formed as a single layer, FIG. 3: a top view of the pneumatic tent in a first embodiment with a pole formed as a single layer, FIG. 4: a front view of the pneumatic tent in a second embodiment h a pole formed as a single layer, FIG. 5: a perspective view of the pneumatic tent in a second embodiment with a pole formed as a single layer, FIG. 6: a top view of the pneumatic tent in a second embodiment with a pole formed as a single layer, FIG. 7: a perspective view of the foot section and the center section of a pole formed of multiple layers, and FIG. 8: a perspective detail view of the torus.

DETAILED DESCRIPTION OF THE INVENTION

FIGS. 1 to 3 show a front view, a perspective view and a plan view of the pneumatic tent 1 according to the invention in a first embodiment with a pole 2 formed as a single layer. The pneumatic tent 1 is constructed as a typical star-shaped canopy tent and has in the illustrated example a pole 2 extending in a final assembly position vertically from the mounting surface 8 and a dome-shaped tent cover 3 extending over the self-supporting pole 2 and being locked and tensioned with respect to the mounting surface 8 with locking means 4. The single pole 2 is here centrally placed relative to the tent cover 3, wherein the dome-shaped tent cover 3 is spread across the apex ii of the pole 2. In this example, the pole 2 containing a pressurized filling gas is formed by only a single layer. The single-layer pole 2 or the single-layer wall of the pole 2 gives the pole 2 its outer shape and also functions as a support structure due to the introduced, pressurized filling gas. As can be seen, the tent cover 3 is constructed in multiple parts or in segments, wherein the individual parts or segments are sewn together. The pole 2 further includes an abrasion-resistant foot section 2.4 resistant to an applied mechanical force, a center section 2.5 and a head section 2.6 operatively connected with the tent cover 3. The detachable or temporary operative connection between the conical head section 2.6 of the pole 2 and the tent cover 3 is realized with a Velcro fastener.

FIGS. 4 to 6 show a front view, a perspective view and a plan view of the pneumatic tent 1 according to the invention in a second embodiment, with a pole 2 being formed as a single layer. The pneumatic tent 1 is constructed as a typical star-shaped canopy tent and has in the illustrated example two poles 2 extending in a final assembly position vertically from the mounting surface 8 and a dome-shaped tent cover 3 extending over the two self-supporting poles 2 and being locked and tensioned with respect to the mounting surface 8 with locking means 4. The two poles 2 are here linearly placed relative to the tent cover 3, i.e. on a common axis, wherein the dome-shaped tent cover 3 is spread across the respective apexes 1,1 of the poles 2. In this example, the two poles 2 which each contain a pressurized filling gas are formed only by a single layer. The two single-layer poles 2 or the single-layer wall of each pole 2 give the poles 2 their outer shape and also function as a support structure due to the introduced, pressurized filling gas. As can be seen, the tent cover 3 is constructed in multiple parts or in segments, wherein the individual parts or segments are sewn together. Each of the poles 2 further includes an abrasion-resistant foot section 2.4 resistant to an applied mechanical force, a center section 2.5 and a head section 2.6 operatively connected with the tent cover 3. The detachable or temporary operative connection between the conical head section 2.6 of each pole 2 and the tent cover 3 is each realized with a Velcro fastener.

FIG. 7 shows a perspective view of the foot section 2.4 and the section 2.5 of a multi-layered pole 2, wherein the individual layers are superpositioned or arranged side-by-side without bonding. A first layer is here an outer skin 2.1 giving the pole 2 its the outer shape and functioning as a supporting structure, and a second layer is formed as an inner tube formed as a filling gas reservoir 2.2 that needs to be filled only once and has a valve 2.3 penetrating the outer skin 2.1. The controllable or adjustable illumination device 5 is in this example inside the inner tube 2.2 formed as a tillable filling gas reservoir. The inner tube 2.2 of each pole 2 is fabricated from a stretchable PU and the outer skin 2.1 consists of a polyester fabric, in this example Dacron. Both the foot section 2.4 and the center section 2.5 have locking means 4 in the form of only schematically illustrated loops, rings, Velcro fasteners or eyelets for securing, on the one hand, the pole 2 with respect to the mounting surface 8 and, on the other hand, for attaching to the pole 2 functional elements in the form of illumination means, loudspeakers, advertising banners, supports or control elements. The center section 2.5 includes a reservoir 7, in which equipment for storing, for example, the compressor provided for one-time filling of the pole 2, power distribution, cables, a control and regulating device or locking means 4 provided as replacement is placed. The illumination device 5 of the pole 2 includes several LEDs designed as backlight and has an adjusting and positioning device 5.1 for precisely aligning the LEDs, which are interconnected with cables, inside the pole 2 in their height and their spacing relative to the outer skin 2.1 of the pole 2. The reference numeral in FIG. 7 indicates an on/off switch for a vertical lifting device of the illumination device 5; however, the on/off switch for the illumination device 5 can also be arranged at this location.

FIG. 8 shows a perspective detailed view of a torus 6 constructed in segments. This torus 6 placed on the mounting surface 8 is preferably associated with the cylinder-shaped pole 2, see FIGS. 1, 3 and 7, with the free cross section of the torus 6 being formed so as to conform to the cross section of the pole 2, wherein the torus having weighting means is coupled with the pole 2 by unillustrated ropes, thus giving the pole 2 sufficient stability. Water or sand is provided as weighting means for the torus 6. The torus 6 may hereby consist of a factory-supplied dimensionally-stable material or be made of a material which acquires its dimensional stability only after being filled with sand or water.

LIST OF REFERENCE NUMERALS

1 Pneumatic Tent
1.1 Apex
2 pole
2.1 Outer skin
2.2 Inner tube
2.3 Valve
2.4 Foot section
2.5 Center section
2.6 Head section
3 Tent Cover
4 Locking means
5 Illumination device
5.1 Adjusting and positioning device
6 Torus
7 Reservoir
8 Mounting surface

The invention claimed is:

1. A pneumatic tent (1), comprising:

at least one self-supporting pole (2), a mounting surface (8), a tent cover (3) without a framework, wherein the self-supporting pole (2) is in direct physical contact with the tent cover (3), wherein the at least one self-supporting pole extends in final assembly position vertically from the mounting surface (8), wherein the self-supporting pole (2) contains a pressurized filling gas, wherein the tent cover (3) is spread across an apex (1.1) of the pole (2), positioned centrally of the tent cover (3), wherein the self-supporting pole (2) includes a controllable or adjustable illumination device (5) that is place inside the pole (2), wherein the self-supporting pole (2) is formed in multiple layers with the layers being superpositioned of each other or arranged side-by-side without bonding, a. a first layer, formed as an outer skin (2.1) giving the pole (2) the outer shape and support, and b. a second layer, formed as an inner tube (2.2) to contain filling gas and having at least one valve (2.3) penetrating the outer skin, wherein the controllable or adjustable illumination device (5) is placed between the inner tube (2.2) formed to contain filling gas and the outer skin (2.1).

2. The pneumatic tent (1) according to claim 1, wherein the self-supporting pole (2) is formed in multiple layers comprising individual layers, each individual layer a. is permanently connected to one another, forming a laminate, and/or b. is superpositioned or arranged side-by-side without bonding to one another.

3. The pneumatic tent (1) according to claim 1, wherein the outer skin (2.1) of the pole (2) is made of polyester.

4. The pneumatic tent (1) according to claim 3, wherein the outer skin (2.1) of the pole (2) comprises an abrasion-resistant foot section (2.4) resistant to an applied mechanical force, a center section (2.5) and a head section (2.6) operatively connected with the tent cover (3), wherein one or more sections (2.4-2.6) comprise a locking device (4) in the form of at least one of loops, rings, Velcro fasteners and eyelets for, on the one hand, securing the pole (2) relative to the mounting surface (8) and, on the other hand, for attaching to the pole (2) functional elements in the form of the illumination device (5), loudspeakers, advertising banners, supports or control elements.

5. The pneumatic tent (1) according to claim 4, wherein the head section is a conical head and wherein the operative connection between the conical head section (2.6) of the pole (2) and the tent cover (3) is realized with a fastener.

6. The pneumatic tent (1) according to claim 4, wherein the foot section (2.4) and/or the center section (2.5) has at least one storage reservoir (7).

7. The pneumatic tent (1) according to claim 4, wherein the center section (2.5) has at least one storage reservoir (7).

8. The pneumatic tent (1) according to claim 3, wherein the polyester is Dacron.

9. The pneumatic tent (1) according to claim 1, further comprising a torus (6) having a cross-section, the torus is placed on the mounting surface (8) and is associated with the self-supporting pole (2), wherein the cross-section of the torus (6) is formed to conform to the cross-section of the pole (2).

10. The pneumatic tent (1) according to claim 9, wherein the torus contains water or sand.

11. The pneumatic tent (1) according to claim 1, wherein the inner tube (2.2) of the pole (2) is composed of a stretchable polyurethane foil.

12. The pneumatic tent (1) according to claim 1, wherein the tent cover (3) and/or the outer skin (2.1) of the pole (2) are constructed from multiple individual parts, wherein the individual parts are one of sewn together, glued, welded or connected by a loop-link connection.

13. The pneumatic tent (1) according to claim 1, wherein the illumination device (5) of the pole (2) includes a plurality of LEDs, configured as a backlight and comprises an adjusting and positioning device (5.1) for exactly aligning the LEDs inside the pole (2), the plurality of LEDs are interconnected with cables with respect to their height and spacing relative to the outer skin (2.1) of the pole (2).

14. The pneumatic tent (1) according to claim 13, wherein the adjusting and positioning device (5.1) comprises a vertical lifting device.

15. The pneumatic tent (1) according to claim 1, wherein the tent cover (3) is a star-shaped canopy.

16. The pneumatic tent of claim 1, wherein the self-supporting pole (2) is constructed as a single layer or as multiple layers.

17. The pneumatic tent of claim 1, wherein the at least one self-supporting pole comprises two poles.

18. The pneumatic tent (1) according to claim 1, wherein the at least one self-supporting pole (2) is a single self-supporting pole.

* * * * *